United States Patent [19]

Yagi et al.

[11] Patent Number: 4,985,993

[45] Date of Patent: Jan. 22, 1991

[54] METHOD FOR PRODUCING WHEEL RIM

[75] Inventors: Nagatada Yagi; Motoatsu Shiraishi; Shizuo Kimura; Yukihisa Watano; Mitsuki Nakamura; Shinji Shinozawa, all of Sayama, Japan

[73] Assignee: Honda Giken Kogyo Kabushiki Kaisha, Tokyo, Japan

[21] Appl. No.: 522,809

[22] Filed: May 11, 1990

[30] Foreign Application Priority Data

May 15, 1989 [JP] Japan ..... 1-120949
May 18, 1989 [JP] Japan ..... 1-122981

[51] Int. Cl.[5] ..... B21K 1/38

[52] U.S. Cl. ..... 29/894.353; 29/894.354; 72/354.2

[58] Field of Search ..... 29/894.35, 894.353, 29/894.354; 72/68, 353.4, 353.6, 354.2

[56] References Cited

U.S. PATENT DOCUMENTS

| | | | |
|---|---|---|---|
| 2,744,426 | 5/1956 | Lyon | 72/354.2 |
| 3,298,218 | 1/1967 | Gollwitzer | 29/894.353 |
| 3,688,373 | 9/1972 | Gregg | 29/894.342 |
| 4,185,370 | 1/1980 | Evans | 29/894.354 |
| 4,408,379 | 10/1983 | Kusano et al. | 29/894.353 |

FOREIGN PATENT DOCUMENTS

| | | |
|---|---|---|
| 50-39625 | 12/1975 | Japan . |
| 56-131033 | 10/1981 | Japan . |

*Primary Examiner*—P. W. Echols

[57] ABSTRACT

A method for producing a wheel rim of an automotive vehicle comprising the steps of supporting a cylindrical body on a vertical axis between an upper punch attached to an upper mold and a lower punch attached to a lower mold; fitting a side die to an outer peripheral surface of the cylindrical body, with the cylindrical body supported; then lowering the upper punch together with the upper mold to insert the upper punch into an upper portion of the cylindrical body and to form the upper end portion of the cylindrical body into the flange portion by press forming between the upper punch and the side die; thereafter releasing the cylindrical body from the supported state at its lower end surface; and further lowering the upper punch together with the side die and the cylindrical body to insert the lower punch into a lower portion of the cylindrical body and to form the lower end portion of the cylindrical body into the flange portion by press forming between the lower punch and the side die, whereby the working steps can be reduced in number.

7 Claims, 11 Drawing Sheets

A
H
d1
c1
b1
a1
a2
b2
c2
d2
Fa1
Fa2
Fb1
Fb2
F1
F2
h1
h2

METHOD FOR PRODUCING WHEEL RIM

BACKGROUND OF THE INVENTION

The present invention relates to a method for producing a wheel rim of an automotive vehicle.

As a wheel rim of an automative vehicle, there is known, for example, the wheel rim having the configuration shown in FIG. 1. Referring to FIG. 1, flange portions $F_1$ and $F_2$ are formed on both sides of a cylindrical well portion W positioned around the center of the wheel rim H, and include first step portions $a_1$ and $a_2$, first side wall portions $b_1$ and $b_2$, second step portions $c_1$ and $c_2$, and second side wall portions $d_1$ and $d_2$ or rim end portions, respectively, formed into step shape having two steps in turn from both ends of the well portion W to opening ends of the wheel rim H. The first side wall portions $b_1$ and $b_2$ of the flange portions $F_1$ and $F_2$ include hump portions $h_1$ and $h_2$ curved and projected outward to secure a tire (not shown in the drawing) on the wheel rim H, and further, the second side wall portions $d_1$ and $d_2$ or the rim end portions are curved so as to project outward.

When this kind of wheel rim H is produced, a cylindrical body formed of a metal material such as an aluminium alloy and having the same diameter as the well portion W has previously been press worked separately at both ends several times to enlarge the diameter of the cylindrical body, thereby gradually forming both the end portions into the shape of the flange portions $F_1$ and $F_2$ described above. More particularly, in the above press working, a side die is fitted to an outer peripheral surface of the cylindrical body and a punch is inserted into the cylindrical body in its axial direction. Both the end portions of the cylindrical body are separately pressed toward the side die by the punch to form the end portions into a prescribed shape. These operations are repeated several times, whereby both the end portions of the cylindrical body are formed into the shape of the flange portions $F_1$ and $F_2$.

In the formation of the hump portions $h_1$ and $h_2$ and the rim end portions $d_1$ and $d_2$ of the wheel rim H, portions corresponding to the above hump portions $h_1$ and $h_2$ of the first side wall portions $b_1$ and $b_2$ are curved so as to project outward to form the hump portions $h_1$ and $h_2$, and the second side wall portions $d_1$ and $d_2$ of the flange portions $F_1$ and $F_2$ are curved so as to project outward to form the above rim end portions $d_1$ and $d_2$.

However, according to the press working method for forming the wheel rim H in which the punch is merely inserted into the cylindrical body and both the end portions of the cylindrical body are radially pressed thereby as described above, if it is tried to form both the end portions into a shape similar to that of the flange portions $F_1$ and $F_2$ at one time, there is a possibility of generation of harmful effects such as buckling due to the action of high tensile load on both the end portions of the cylindrical body. For this reason, it is necessary that both the end portions of the cylindrical body are separately press worked several times as described above. A large number of working steps are therefore required, which results in an obstacle to an improvement in manufacturing efficiency of the wheel rim H.

It is therefore an object of the present invention to provide a method by which such a disadvantage can be canceled and a wheel rim can be efficiently produced with less working steps than prior-art methods.

SUMMARY OF THE INVENTION

In accordance with the present invention, there is provided a method for producing a wheel rim of an automotive vehicle including a press forming procedure for forming a cylindrical body formed of a metal material into the wheel rim having flange portions of prescribed shape by press working, said press forming procedure comprising the steps of supporting said cylindrical body at a lower end surface thereof on a vertical axis between an upper punch attached to an upper mold and a lower punch attached to a lower mold; fitting a side die to an outer peripheral surface of said cylindrical body, with said cylindrical body supported; then lowering said upper punch together with the upper mold to insert the upper punch into an upper portion of said cylindrical body and to form the upper end portion of said cylindrical body into said flange portion by press forming between said upper punch and said side die; thereafter releasing said cylindrical body from the supported state at its lower end surface; and further lowering said upper punch together with said side die and said cylindrical body to insert the lower punch into a lower portion of said cylindrical body and to form the lower end portion of said cylindrical body into said flange portion by press forming between said lower punch and said side die.

According to the manufacturing method of the present invention, the flange portions are formed at the upper end portion and the lower end portion of the cylindrical body in turn by two press forming steps for each one lowering movement.

Accordingly, the manufacturing method of the wheel rim of the present invention can reduce the manufacturing steps of the wheel rim in number to improve its manufacturing efficiency.

In accordance with another aspect of the present invention, there is provided a method for producing a wheel rim of an automotive vehicle having flange portions formed on both sides of a cylindrical well portion positioned around the center of the wheel rim, the flange portions being formed into step shape having two steps by first step portions, first side wall portions, second step portions and second side wall portions, respectively, in turn from both ends of the well portion to opening ends of the wheel rim, both the first side wall portions having hump portions curved and projected outward, both the second side wall portions or rim end portions being curved so as to project outward, which comprises the steps of forming both end portions of a cylindrical body formed of a metal material and having the same diameter as the well portion into flange portions having almost the same shape as the above flange portions and having the first step portions, the first side wall portions, the second step portions and the second side wall portions which are smooth; and then, laterally fitting a divided side die to an outer peripheral surface of the cylindrical body having both said flange portions formed and axially pressing said cylindrical body between a pair of punches inserted into both said flange portions, respectively, thereby curving prescribed portions of the first side wall portions of the respective flange portions toward concaves formed on said side die to form said hump portions and curving the second side wall portions of the respective flange portions toward concaves formed on said side die to form said rim end portions.

According to the manufacturing method of the present invention, the cylindrical body whose end portions are press formed into the above flange portions in the above flange forming step are axially pressed between a pair of punches in the forming steps of the hump portions and the rim portions. As a result, prescribed portions of the first side wall portions and the second side wall portions smoothly formed on the respective flange portions are curved toward concaves formed on the above side die, so that the above hump portions and the above rim portions are formed by press working using these punches and side die, whereby the wheel rim can be obtained.

Hence, according to the present invention, the hump portions and the rim portions can be efficiently produced by press working, and therefore, the hump portions and the rim portions can be produced for a short time, which results in an improvement in the manufacturing efficiency of the wheel rim.

DESCRIPTION OF THE PREFERRED EMBODIMENTS

Figure 1:
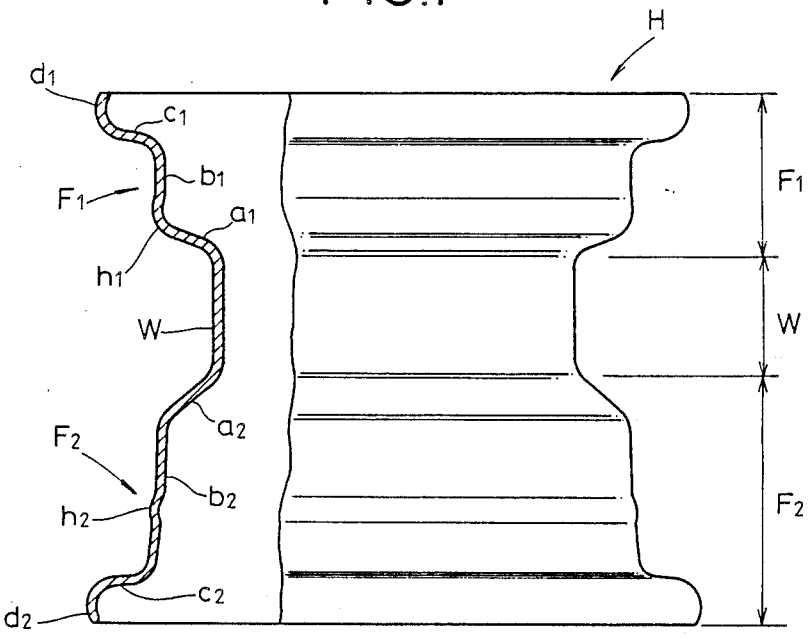
FIG. 1 is a cross sectional view showing an embodiment of a wheel rim.
Figures 2A, 2B, 2C, 2D:
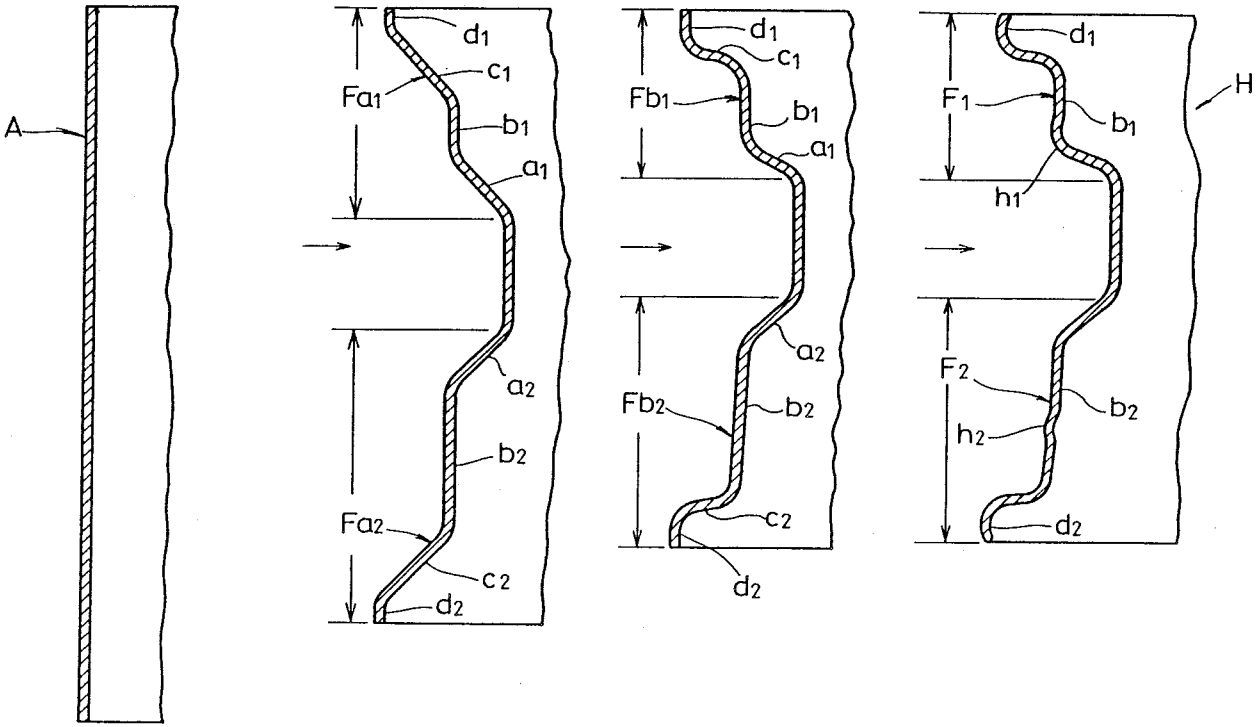
FIGS. 2(*a*) to 2(*d*) are cross sectional views illustrating an example of a method of the present invention.

The present invention will hereinafter be described in connection with the accompanying drawings. FIGS. 2(*a*) to 2(*d*) are cross sectional views for explaining a method for producing the wheel rim H shown in FIG. 1.

In this preparing method, both end portions of a cylindrical body A formed of an iron alloy, an aluminium alloy or the like and shown in FIG. 2(*a*) are first enlarged in diameter to form primary flange portions $Fa_1$ and $Fa_2$ having shape similar to that of the flange portions $F_1$ and $F_2$ of the above wheel rim H as shown in FIG. 2(*b*). At this time, all of first step portions $a_1$ and $a_2$, first side wall portions $b_1$ and $b_2$, second step portions $c_1$ and $c_2$, and second wall portions $d_1$ and $d_2$ constituting the flange portions $Fa_1$ and $Fa_2$ are smoothly formed, and the first step portions $a_1$ and $a_2$ and the second step portions $c_1$ and $c_2$ are formed at relatively small oblique angles to an axis of the cylindrical body A.

Then, the primary flange portions $Fa_1$ and $Fa_2$ are formed so that the first step portions $a_1$ and $a_2$ and the second step portions $c_1$ and $c_2$ are increased in oblique angle to press form preliminary flange portions $Fb_1$ and $Fb_2$ having almost the same shape as the above flange portions $F_1$ and $F_2$ and having the first step portions $a_1$ and $a_2$, the first side wall portions $b_1$ and $b_2$, the second step portions $c_1$ and $c_2$, and the second wall portions $d_1$ and $d_2$ all of which are smooth as shown in FIG. 2(*c*). Thereafter, precribed portions of the first side wall portions $b_1$ and $b_2$ of the flange portions $Fb_1$ and $Fb_2$ and the second wall portions $d_1$ and $d_2$ are curved so as to project outward to form the hump portions $h_1$ and $h_2$ and the rim end portions $d_1$ and $d_2$ as shown in FIG. 2(*d*), thereby obtaining the wheel rim H.

Each of the above forming steps is carried out by the press working described below in detail.

Figure 3:
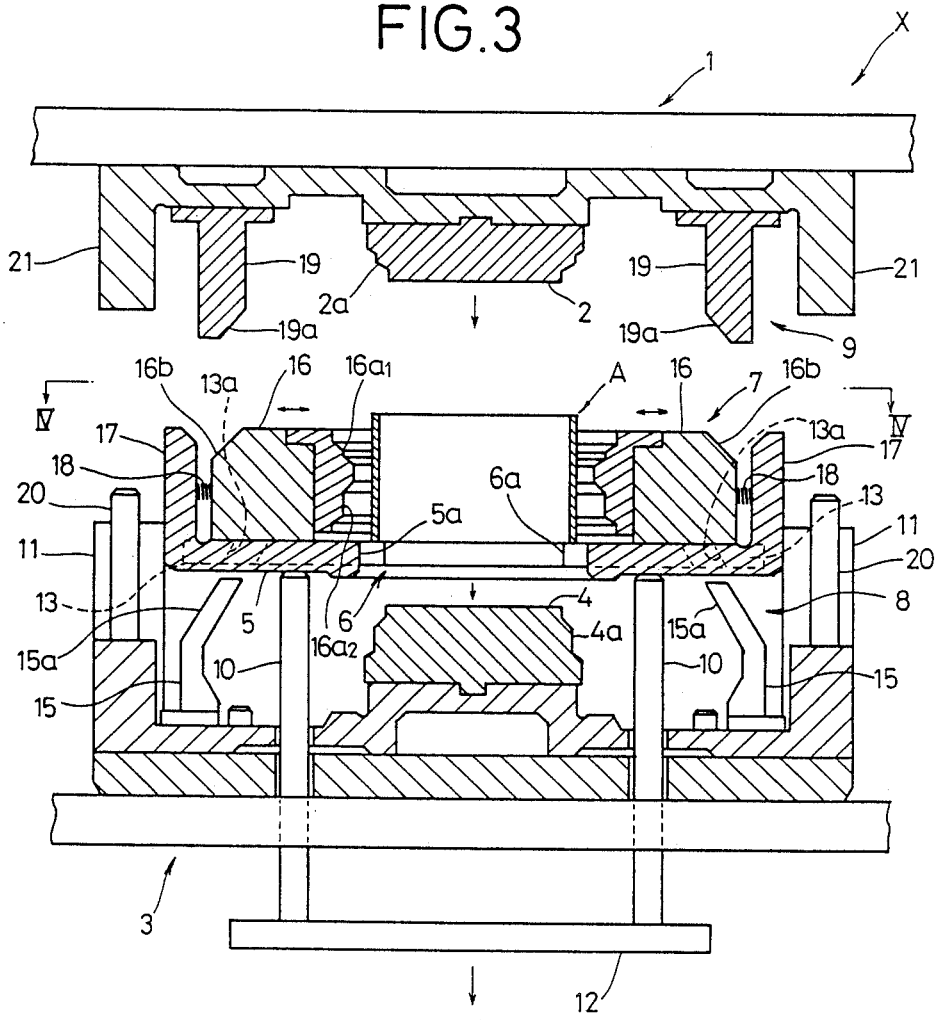
FIG. 3 is a cross sectional view showing an embodiment of a press apparatus used in the present invention.
Figure 4:
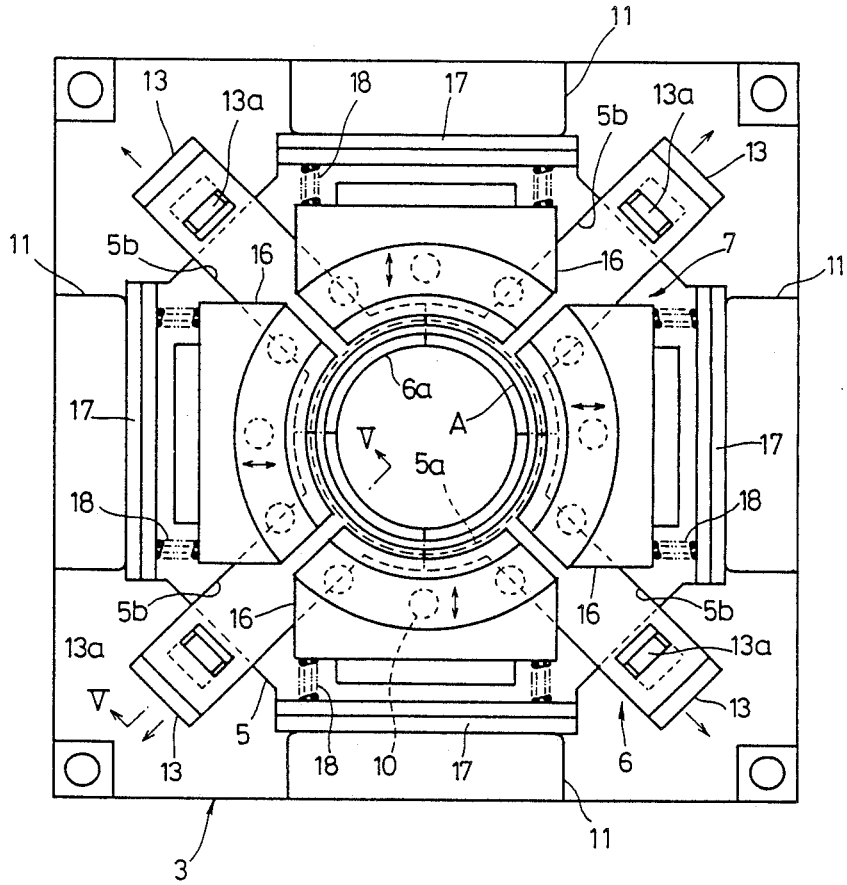
FIG. 4 is a cross sectional view taken along line IV—IV in FIG. 3.
Figure 5:
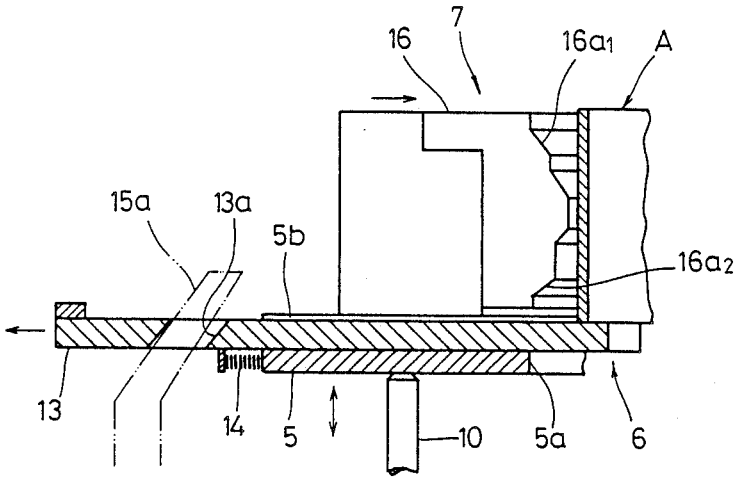
FIG. 5 is a cross sectional view taken along line V—V in FIG. 4.

A method for forming the primary flange portions $Fa_1$ and $Fa_2$ and a press apparatus X used in this forming method are described according to FIGS. 3 to 6(*a*) and 6(*b*). FIG. 3 is a cross sectional view showing the press apparatus X, FIG. 4 is a cross sectional view taken along line IV—IV in FIG. 3, FIG. 5 is a cross sectional view taken along line V—V in FIG. 4, and FIGS. 6(*a*) and 6(*b*) are cross sectional views explaining the operation of this press apparatus.

Referring to FIGS. 4 and 5, the reference numeral 1 indicates an upper mold having an upper punch 2 attached to a lower surface thereof and movable up and down together with the upper punch 2, and the reference numeral 3 indicates a lower mold having a lower punch 4 attached to an upper surface thereof directly under the upper punch 2. The reference numeral 5 indicates a vertical ramp mounted between the molds 1 and 3 so as to be movable up and down, and the reference numeral 6 indicates a supporting table for supporting detachably a lower surface of the above cylindrical body A mounted on the ramp 5 so as to be movable up and down together therewith, coaxially with both the punches 2 and 4 on a vertical axis. The reference numeral 7 indicates a side die mounted on the ramp 5 around the cylindrical body A supported on the supporting table 6, so as to be movable up and down together with the ramp 5, and the reference numeral 8 indicates a detaching means for detaching the supporting table 6 supporting the cylindrical body A from the cylindrical body A. The reference numeral 9 indicates a transfer means for transferring the side die 7 to fit the side die to an outer peripheral surface of the cylindrical body supported on the supporting table 6.

Outer surfaces of both the punches 2 and 4 are provided with forming surfaces 2*a* and 4*a*, respectively, having almost the same shape as inner surfaces of the primary flange portions $Fa_1$ and $Fa_2$ as shown in FIG. 3. The punches 2 and 4 are formed so that they are inserted into an upper portion and a lower portion, respectively, of the cylindrical body A mounted between the punches 2 and 4, coaxially therewith on a vertical axis and tip surfaces thereof are brought into abutting contact with each other at an approximately central position of the cylindrical body A, when the upper punch 2 goes down together with the upper mold 1 toward the lower punch 4.

The ramp 5 passes through the lower mold 3 from the lower side thereof and is supported so as to be movable up and down by upper end portions of cushion pins 10 projecting to the upper mold 1. An outer peripheral surface thereof is brought into slidable contact with inner surfaces of backup members 11 vertically mounted on side portions of the lower mold 3 to be movable up and down along the inner surfaces. The cushion pins 10 are vertically attached on a cushion plate 12 mounted under the lower mold 3 so as to be movable up and down and urged upward with a spring or the like not shown in the drawings, and urge the ramp 5 upward. The ramp 5 is provided with a circular opening 5a between the punches 2 and 4, the opening having such a diameter that the lower punch 4 is passable therethrough when it goes down. As shown in FIGS. 4 and 5, a plurality of grooves radially extending from the opening 5a are formed on an upper surface of the ramp 5.

The supporting table 6 comprises a plurality of transfer tables 13 each brought into engagement with the grooves 5b formed on the ramp 5 so as to be movable horizontally along the grooves and so as to be movable up and down together with the ramp 5, as shown in FIGS. 4 and 5. Each of the transfer tables 13 is connected to the ramp 5 through a spring 14, and urged to the center of the opening 5a as shown in FIG. 5. By this urging, tip portions of the transfer tables 13 are each protruded into the opening 5a, and the adjacent tip portions come into abutting contact with each other as shown in FIG. 4. When the tip portions of the transfer tables 13 are in abutting contact, a ring-shaped supporting portion 6a is formed along a lower end surface of the cylindrical body A. The cylindrical body A is supported coaxially with the punches 2 and 4 by the supporting portion 6a as shown in FIG. 3. Further, rear portions of the transfer tables 13 are each provided with cam holes 13a extending diagonally up and down as shown in FIG. 5.

The detaching means 8 has arms 15 vertically mounted on the lower mold 3, each arm being arranged under each of the cam holes 13a formed in the transfer tables 13. The arm 15 includes a cam 15a which is brought into engagement with the cam hole 13a as indicated by the hypothetical line in FIG. 5, when the supporting table 6 goes down together with the ramp 5. The cams 15a and the cam holes 13a are formed so that the tip portions of the transfer tables 13 are detached from the cylindrical body A supported by the supporting portion 6a with the descending movement of the supporting table 6 to move radially along the grooves 5b to positions in which the lower punch 4 is passable through the opening 5a of the ramp 5.

The side die 7 comprises a plurality of dies 16 arranged in the circumferential direction of the cylindrical body A so as to surround the outer peripheral surface of the cylindrical body A supported on the supporting table 6 as illustrated in FIGS. 3 and 4. The dies 16 are each mounted on the ramp 5 apart from one another so as to be horizontally movable on the ramp 5 in radial directions with respect to the cylindrical body A. Each of the dies 16 is connected at its outer surface to each of backup members 17 vertically mounted on side portions of the ramp 5 through springs 18 to urge the dies in such a direction as to detach the dies from the cylindrical body A as shown in FIG. 4. Each of the dies 16 has forming surfaces $16a_1$ and $16a_2$ at upper and lower portions of its inner surface as shown in FIG. 5, for the purpose of forming divided outer peripheral surfaces of the primary flange portions $Fa_1$ and $Fa_2$, respectively. When the dies 16 are transferred toward the cylindrical body A supported on the supporting table 6, the dies 16 come into abutting contact with one another to fit the side die 7 to the whole outer peripheral surface of the cylindrical body A. Each of these forming surfaces $16a_1$ and $16a_2$ also forms a continuous surface having almost the same shape as each of the outer peripheral surfaces of the primary flange portions $Fa_1$ and $Fa_2$.

The above transfer means 9 is provided with guide members 19 attached in a pendent form to the lower surface of the upper mold 1 over spaces between the backup members of the ramp 5 and the dies 16 as illustrated in FIG. 3. On the guide members 19 are formed cams 19a which are brought into engagement with cam surfaces 16b formed on the outer surfaces of the dies 16 when the upper mold 1 goes down. The cams 19a and the cam surfaces 16b cause the dies 16 to transfer toward the cylindrical body A with the descending movement of the upper mold 1 as described above, and force the guide members 19 to enter the spaces between the backup members 17 and the dies 16, thereby fitting the side die 7 to the outer peripheral surface of the cylindrical body A.

Referring to FIG. 3, the reference numeral 20 indicates guide posts vertically mounted on the side portions of the lower mold 3. When the upper mold 1 goes down, guide bushes 21 attached to the side portions of the upper mold 1 in a pendent form are guided by the guide posts 21.

A flange forming procedure using such a press apparatus X is hereinafter described in accordance with FIG. 3 and FIGS. 6(*a*) and 6(*b*).

First, as shown in FIG. 3, the cylindrical body A is supported on the supporting table 6 as described above, and the upper mold 1 goes down toward the lower mold 3 in this state, whereby the upper punch 2 goes down toward the cylindrical body A.

In the course of this descending movement, the cams 19a of the guide members 19 are first brought into engagement with the cam surfaces 16b of the dies 16 constituting the side die 7 to cause the dies 16 to transfer toward the cylindrical body A as described above. At that time, the guide members 19 enter the spaces between the backup members 17 of the ramp 5 and the dies 16 as illustrated in FIG. 6(*a*), whereby the dies 16 are each pressed on the outer peripheral surface of the cylindrical body A to fit the side die 7 to the whole outer peripheral surface thereof.

Figure 6A:
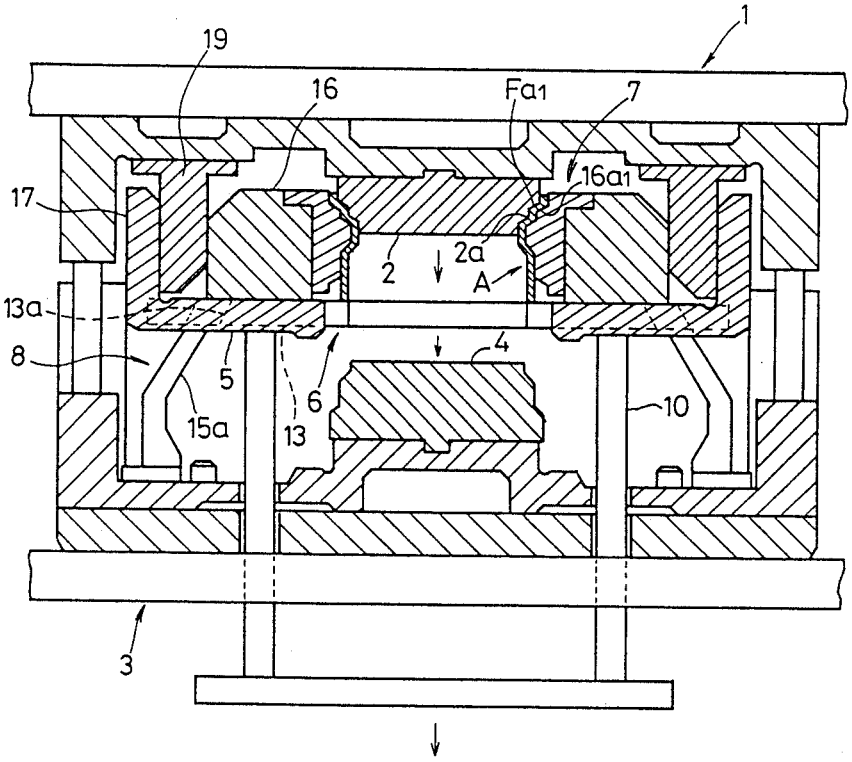
FIGS. 6(*a*) and 6(*b*) are cross sectional views explaining the operation of the press apparatus shown in FIG. 3.
Figure 6B:
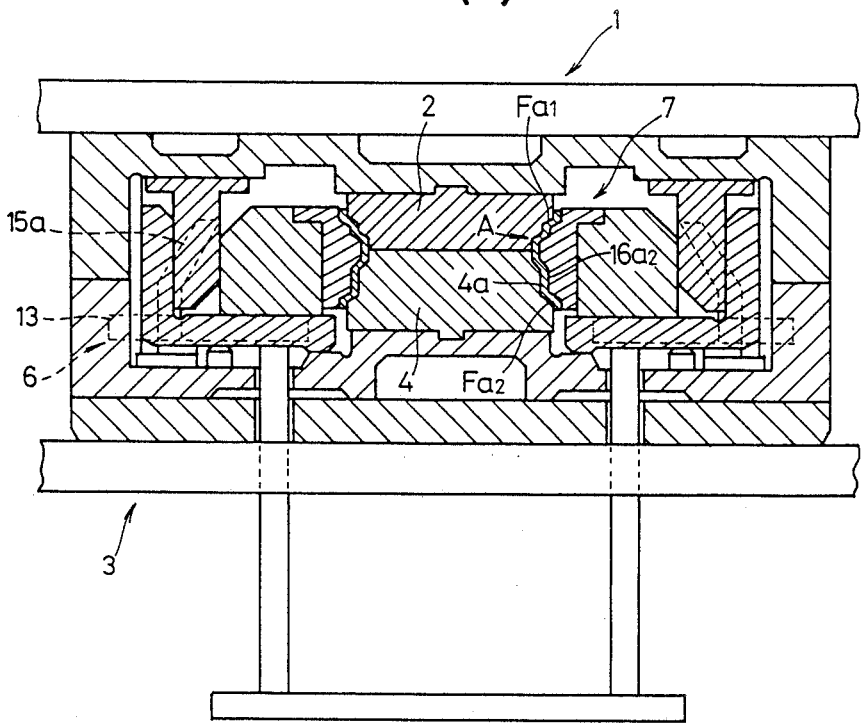

On the other hand, at about the same time that the side die 7 is fitted to the outer peripheral surface of the cylindrical body A, the upper punch 2 is inserted into the upper portion of the cylindrical body A to press it toward the side die 7 as shown in FIG. 6(*a*). The upper portion of the cylindrical body A is radially enlarged in diameter thereby to form the flange portion $Fa_1$ between the forming surface 2a of the upper punch 2 and the continuous forming surface $16a^1$ of the side die 7. At this time, the side die 7 and the supporting table 6 are urged upward through the ramp 5 by the cushion pins 10. This urging force is established to such a degree that the upper punch 2 can press the upper portion of the cylindrical body A toward the side die 7 and that the upper mold 1 is not prevented from the descending movement.

After the forming procedure described above has been completed, as the upper mold 1 further goes down, the upper punch 2 is lowered together with the cylindrical body A, the side die 7, the supporting table 6 and the ramp 5. In the course of it, the cams 15a of the detaching means 8 are first brought into engagement with the cam holes 13*a* of the transfer tables 13 included in the supporting table 6 as described above, and each of the transfer tables 13, namely the supporting table 6, is detached from the lower end surface of the cylindrical body A with the descending movement described above as shown in FIG. 6(*b*), thereby releasing the support of the cylindrical body A. Subsequently, the lower punch 4 is further inserted into the lower portion of the cylindrical body A as illustrated in FIG. 6(*b*). At this time, the upper punch 2 inserted into the upper portion of the cylindrical body A presses the lower portion of the cylindrical body A through the side die 7 toward the lower punch 4. The lower portion of the cylindrical body A is radially enlarged in diameter thereby to form the primary flange portion $Fa_2$ between the forming surface 4*a* of the lower punch 4 and the continuous forming surface 16*a*$_2$ of the side die 7. In this forming procedure, the tip surfaces of both the punches 2 and 4 are brought into abutting contact with each other at an approximately central position of the cylindrical body A as shown in FIG. 6(*b*), and therefore, the cylindrical body A is not excessively pressed between the punches 2 and 4 and the side die 7.

Thus, according to the above press forming, the primary flange portions $Fa_1$ and $Fa_2$ are formed in turn by one press operation. In this case, since the first step portions $a_1$ and $a_2$ and the second step portions $c_1$ and $c_2$ of the primary flange portions $Fa_1$ and $Fa_2$ are small in oblique angle, the steep enlargement of the diameter does not occur at both the end portions of the cylindrical body A. Accordingly, the tensile load acting on both the end portions of the cylindrical body A is relatively low, and therefore, the primary flange portions $Fa_1$ and $Fa_2$ can be formed without hindrance.

At the same time that such forming is completed, the ascending movement of the upper mold 1 is terminated, and then the upper mold 1 is forced to go up to the initial position. This ascending movement detaches the lower punch 4, the upper punch 2 and the side die 7 in turn from the cylindrical body A on which the primary flange portions $Fa_1$ and $Fa_2$ have been formed, by operations reverse to the above ones, whereas the cylindrical body A supported on the supporting table 6 is carried out of the press apparatus X while maintaining this state.

Figure 7:
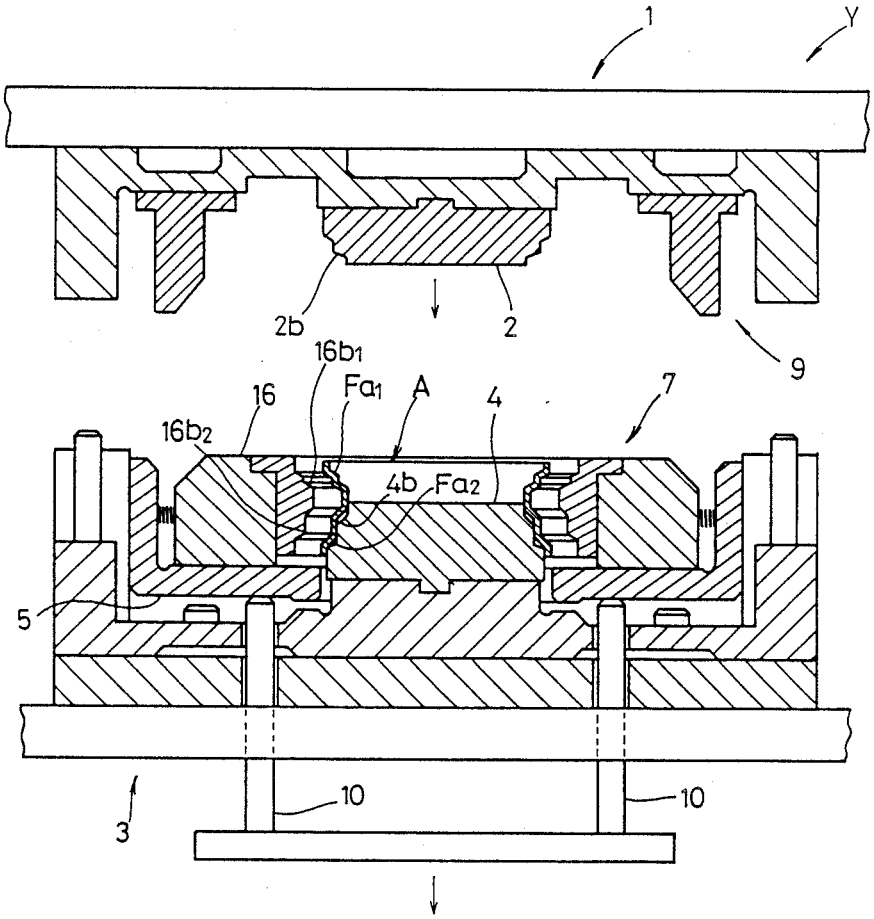
FIG. 7 is a cross sectional view showing another embodiment of the press apparatus used in the present invention.

A method for forming the primary flange portions $Fa_1$ and $Fa_2$ into the above flange portions $Fb_1$ and $Fb_2$, and a press apparatus Y used in this forming method are hereinafter described according to FIG. 7 and FIGS. 8(*a*) and 8(*b*). FIG. 7 is a cross sectional view showing the press apparatus Y, and FIGS. 8(*a*) and 8(*b*) are cross sectional views explaining the operation of a main portion thereof.

This press apparatus Y has basically the same structure as the above press apparatus X. As shown in FIG. 7, the press apparatus Y comprises an upper mold 1 having an upper punch 2, a lower mold 3 having a lower punch 4, a ramp 5 mounted between both the molds 1 and 3 so as to be movable up and down and urged upward by cushion pins 10, a side die 7 formed of a plurality of dies 16 mounted on the ramp 5 so as to be horizontally movable, and a transfer means 9 for transferring the dies 16 to fit the side die 7 to the outer peripheral surface of the cylindrical body A having the primary flange portions $Fa_1$ and $Fa_2$. This constitution is the same as with the above press apparatus X. However, this press apparatus Y is not provided with the supporting table 6 and the detaching means 8 which the above press apparatus X includes. The cylindrical body A having the primary flange portions $Fa_1$ and $Fa_2$ is mounted coaxially with both the punches 2 and 4, and the lower punch 4 is directly inserted into the lower portion of the cylindrical body A, thereby supporting the cylindrical body A. The upper mold 1 is lowered in this state to perform press working. The punches 2 and 4 have at outer peripheral surfaces thereof forming surfaces 2*b* and 4*b*, respectively, having almost the same shape as the inner peripheral surfaces of the flange portions $Fb_1$ and $Fb_2$. An upper end portion of the forming surface 2*b* and a lower end surface of the forming surface 4*b* are provided with jaw portions 2*x* and 4*x*, respectively, to which both ends of the cylindrical body A is fixed when both the punches 2 and 4 are inserted into the cylindrical body A, as illustrated in FIG. 8(*a*). On upper and lower inner portions of each of the dies 16 constituting the side die 7 are formed forming surfaces 16*b*$_1$ and 16*b*$_2$, respectively, which have almost the same shape as the outer peripheral surfaces of the flange portions $Fb_1$ and $Fb_2$.

Figure 8B:
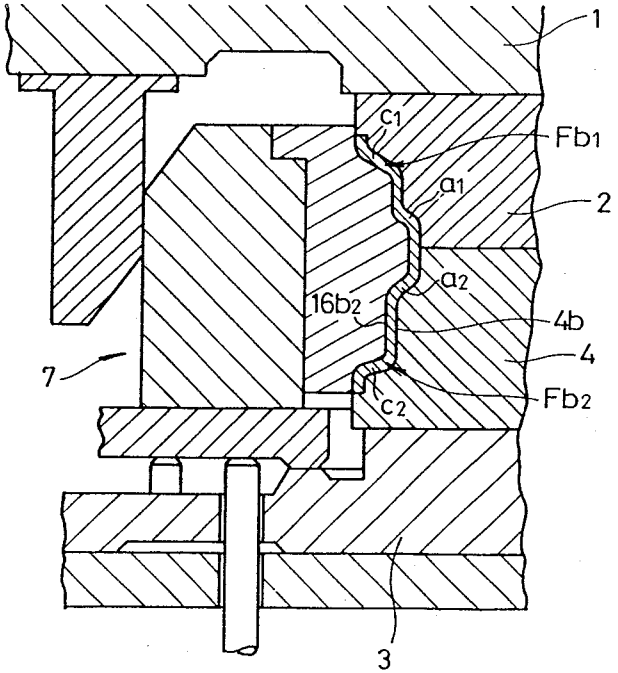
FIGS. 8(*a*) and 8(*b*) are cross sectional views explaining the operation of the press apparatus shown in FIG. 7.
Figure 8A:
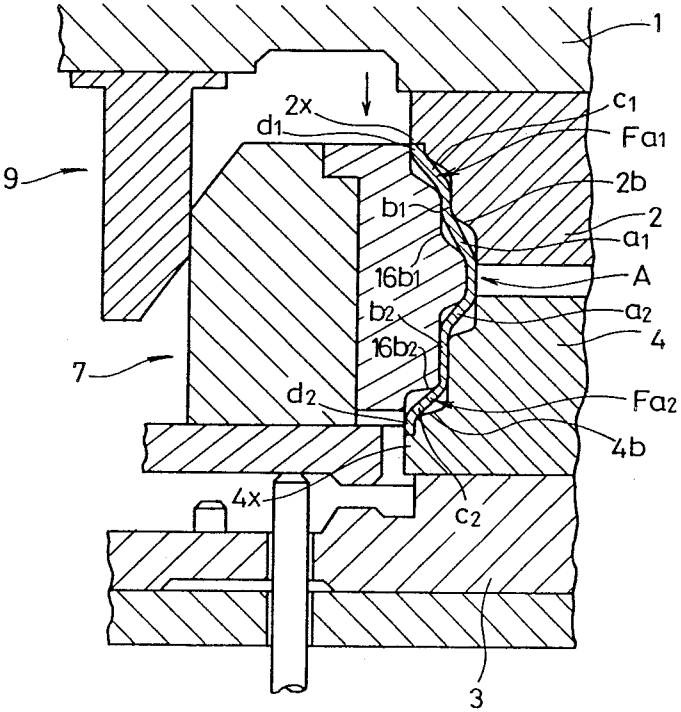

In such a press forming procedure, each of the dies 16 constituting the side die 7 is first transferred by the transfer means 9 with the descending movement of the upper mold 1 as with the press apparatus X to fit the side die 7 to the whole outer peripheral surface of the cylindrical body A having the primary flange portions $Fa_1$ and $Fa_2$ as shown in FIG. 8(*a*). At that time, the upper punch 2 is inseted into the upper portion of the cylindrical body A. Thus, the primary flange portion $Fa_1$ of the cylindrical body A is formed into the flange portion $Fb_1$ between the forming surface 2*b* of the upper punch 2 and the forming surface 16*b*$_1$ of the side die 7. Subsequently, the further descending movement of the upper mold 1 depress the upper punch 2 and the side die 7 a little to form the primary flange portion $Fa_2$ into the flange portion $Fb_2$ between the forming surface 4*b* of the lower punch 4 and the forming surface 16*b*$_2$ of the side die 7 as shown in FIG. 8(*b*).

More particularly, in the forming of the flange portions $Fb_1$ and $Fb_2$, both ends of the cylindrical body A having the primary flange portions $Fa_1$ and $Fa_2$ are fixed to the jaw portions 2*x* and 4*x* of both the punches 2 and 4 as shown FIG. 8(*a*), when the punches 2 and 4 are inserted into the cylindrical body A. At that time, both the side wall portions $b_1$ and $d_1$ of the primary flange portion $Fa_1$ and both the side wall portions $b_2$ and $d_2$ of the primary flange portion $Fa_2$ are sandwiched between the upper punch 2 and the side die 7 and between the lower punch 4 and the side die 7, respectively. In this state, with the descending movement of the upper punch 2, both the side wall portions $b_1$ and $d_1$ of the primary flange portion $Fa_1$ are first axially pressed, and both the step portions $a_1$ and $c_1$ of the primary flange portion $Fa_1$ are pressed toward the side die 7 so as to be increased in oblique angle between the upper punch 2 and the side die 7. This forms the primary flange portion $Fa_1$ into the flange portion $Fb_1$ as shown in FIG. 8(*b*). Then, the upper punch 2 is further lowered, thereby forming the primary flange portion $Fa_2$ into the flange portion $Fb_2$ in a manner similar to that described above.

Thus, the flange portions $Fb_1$ and $Fb_2$ are formed in turn by one press operation as is the case with the primary flange portions $Fa_1$ and $Fa_2$ described above. In this case, the cylindrical body A provided with the primary flange portions $Fa_1$ and $Fa_2$ is fixed between the jaw portion 2*x* of the punch 2 and the jaw portion 4*x* of the punch 4, and axially pressed. At that time, the first side wall portions $b_1$ and $b_2$ and the second side wall portions $d_1$ and $d_2$ of the primary flange portions $Fa_1$ and $Fa_2$ are sandwiched between the upper punch 2 and the side die 7 and between the lower punch 4 and the side die 7, respectively. Maintaining this state, the first step portions $a_1$ and $a_2$ and the second step portions $c_1$ and $c_2$ of the primary flange portions $Fa_1$ and $Fa_2$ are pressed in the direction in which they are reduced in oblique angle. Hence, the tensile load acting on the primary flange portions $Fa_1$ and $Fa_2$ is low, resulting in no generation of harmful effects such as buckling. The flange portions $Fb_1$ and $Fb_2$ can therefore be produced without hindrance.

In the above press forming procedure, when the forming operation is terminated, the tip surfaces of both the punches 2 and 4 are brought into abutting contact with each other to prevent the cylindrical body A from excessive pressing as shown in FIG. 8(*b*) as with the above press apparatus X.

Figure 9B:
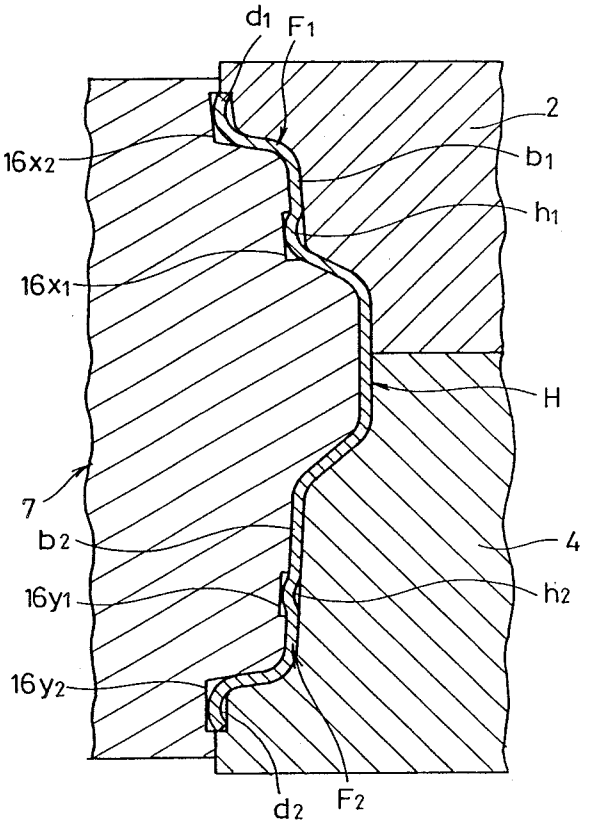
FIGS. 9(*a*) and 9(*b*) are cross sectional views explaining the operation of a main portion of another embodiment of the press apparatus.
Figure 9A:
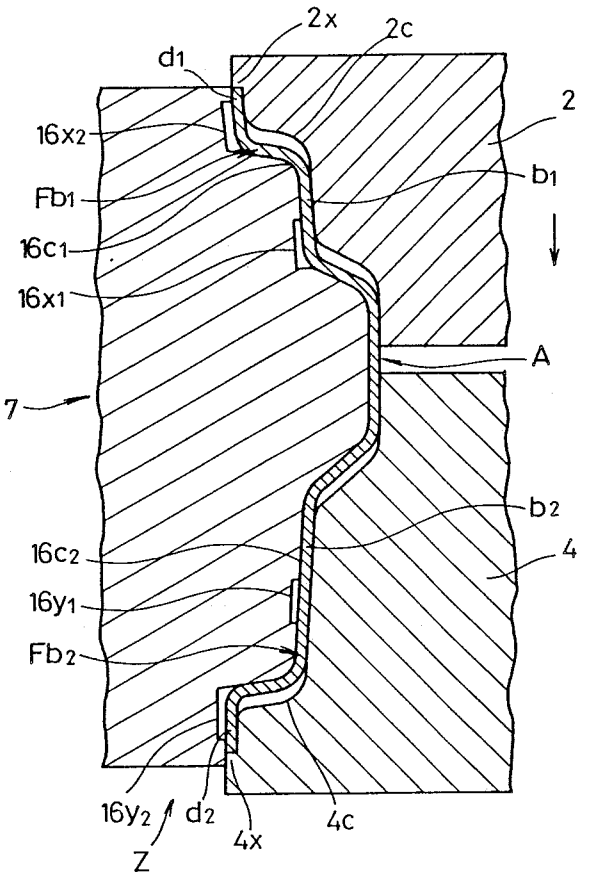

A method for press forming the hump portions $h_1$ and $h_2$ and the rim end portions $d_1$ and $d_2$ on the flange portions $Fb_1$ and $Fb_2$, and a press apparatus Z used in this forming method are hereinafter described according to FIGS. 9(*a*) and 9(*b*). FIGS. 9(*a*) and 9(*b*) are cross sectional views explaining the operation of a main portion thereof.

The press apparatus Y has basically the same structure as the above press apparatus Y. As shown in FIG. 9(*a*), on a side die 7 is formed a forming surface $\mathbf{16}c_1$ having almost the same shape as the outer peripheral surface of the flange portion $F_1$ of the above wheel rim H. Concaves $\mathbf{16}x_1$ and $\mathbf{16}x_2$ are formed in the circumferential direction in positions corresponding to the hump portion $h_1$ and the rim end portion $d_1$ of the forming surface $\mathbf{16}c_1$, respectively, and a forming surface $\mathbf{16}c_2$ having almost the same shape as the outer peripheral surface of the flange portion $F_2$ is formed on the lower portion of the side die 7. Concaves $\mathbf{16}y_1$ and $\mathbf{16}y_2$ are formed in the circumferential direction in positions corresponding to the hump portion $h_2$ and the rim end portion $d_2$ of the forming surface $\mathbf{16}c_2$, respectively. Further, the outer peripheral surfaces of both punches 2 and 4 have almost the same shape as the inner peripheral surface of the flange portions $F_1$ and $F_2$, and forming surfaces 2*c* and 4*c* thereof have smoothly formed surfaces corresponding to the first side wall portions $b_1$ and $b_2$ and the second side wall portions $d_1$ and $d_2$ of the flange portions $F_1$ and $F_2$, respectively. Furthermore, an upper end portion of the forming surface 2*c* and a lower end portion of the forming surface 4*c* are provided with jaw portions 2*x* and 4*x*, respectively, as with the above press apparatus Y.

In such a press apparatus Z, when the upper punch 2 is inserted into the upper portion of the cylindrical body A provided with the flange portions $Fb_1$ and $Fb_2$ as with the press apparatus Y, the cylindrical body A is fixed between the jaw portion 2*x* of the punch 2 and the jaw portion 4*x* of the punch 4 as illustrated in FIG. 9(*a*). The first side wall portions $b_1$ and $b_2$ and the second side wall portions $d_1$ and $d_2$ of the flange portions $Fb_1$ and $Fb_2$ are sandwiched between the upper punch 2 and the side die 7 and between the lower punch 4 and the side die 7, respectively. With the descending movement of the upper punch 2 in this state, both the side wall portions $b_1$ and $d_1$ of the flange portion $Fb_1$ are axially pressed to curve. At this time, the side wall portions $b_1$ and $d_1$ can not curve to the side of the upper punch 2, because the forming surface 2*c* of the upper punch 2 has smoothly formed surfaces corresponding to the side wall portions $b_1$ and $d_1$. For this reason, the side wall portions $b_1$ and $d_1$ curve at positions corresponding to the concaves $\mathbf{16}x_1$ and $\mathbf{16}x_2$ so as to project into the concaves $\mathbf{16}x_1$ and $\mathbf{16}x_2$ as shown in FIG. 9(*b*). The hump portion $h_1$ and the rim end portion $d_1$ are formed thereby, and the flange portion $Fb_1$ is formed into the final flange portion $F_1$ described above.

Then, the upper punch 2 is further lowered, whereby the side wall portions $b_2$ and $d_2$ of the flange portion $Fb_2$ curve at positions corresponding to the concaves $\mathbf{16}y_1$ and $\mathbf{16}y_2$ of the side die 7 so as to project into the concaves $\mathbf{16}y_1$ and $\mathbf{16}y_2$ as shown in FIG. 9(*b*). The hump portion $h_2$ and the rim end portion $d_2$ are formed thereby, and the flange portion $Fb_2$ is formed into the final flange portion $F_2$ described above. Thus, the wheel rim H is obtained.

As described above, according to this example, the flange portions having a desired shape are formed on the upper end portion and the lower end portion of the cylindrical body A in turn, using the above press apparatus X,Y, and Z, by one press step for each apparatus. The cylindrical body A is therefore formed into the wheel rim H by three press steps in total, which results in a reduction in number of steps.

In this example, the flange portions $Fb_1$ and $Fb_2$ are formed on both the end portions of the cylindrical body A by two press step. However, if the flange portions $Fb_1$ and $Fb_2$ have, for example, the step portions relatively small in oblique angle, it is of course possible to produce the wheel rim H by forming the flange portions by one press step and then forming the hump portions and the rim end portions on the flange portions.

Figure 10:
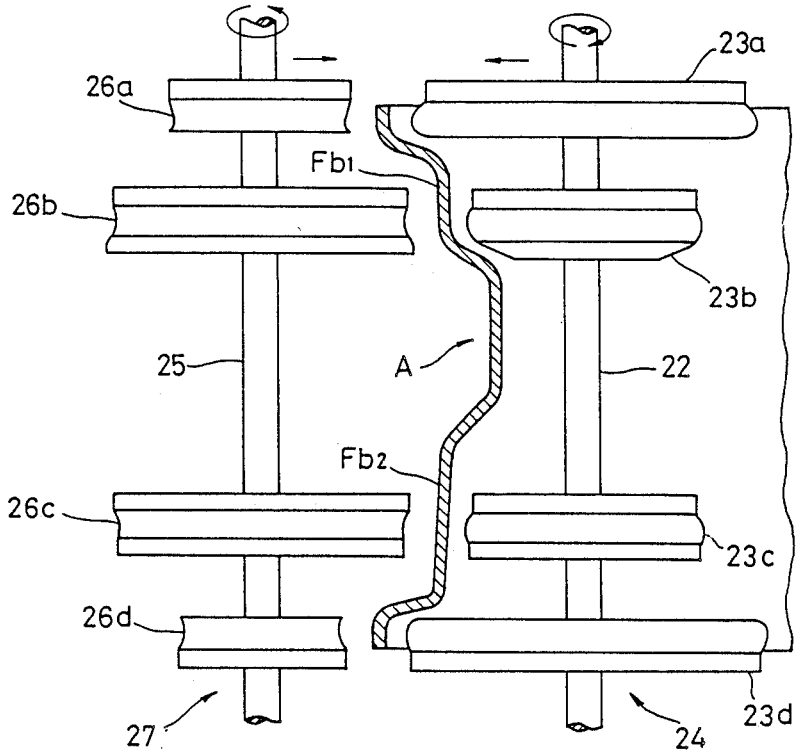
FIG. 10 is a view for explaining a forming method of hump portions by roll forming.

In the above example, there is described the method in which the hump portions and the rim portions are formed by press forming. As another method of the present invention, there is hereinafter described according to FIG. 10 a method in which the hump portions $h_1$ and $h_2$ are formed on the flange portions $Fb_1$ and $Fb_2$ by roll forming and the end portions of the flange portions $Fb_1$ and $Fb_2$ are bent. FIG. 10 is a view for explaining the roll forming procedure.

In this roll forming procedure, as shown in FIG. 10, there are used forming roll 24 having four roll dies 23*a* to 23*d* integrally rotatably mounted on a rotation axis 22, and forming roll 27 having four roll dies 26*a* to 26*d* integrally rotatably mounted on a rotation axis 25. The roll dies 23*a* to 23*d* of the forming roll 24 and the roll dies 26*a* to 26*d* of the forming roll 27 are spaced on the rotation axes 22 and 25, respectively, at the same intervals as the end portion of the flange portion $Fb_1$, a portion for forming the hump portion $h_1$, a portion for forming the hump portion $h_2$ and the end portion of the flange portion $Fb_2$ are axially spaced on the cylindrical body A.

In forming, the forming roll 24 is axially inserted into the cylindrical body A, and the roll dies 23*a* to 23*d* are positioned at the sides of the end portion of the flange portion $Fb_1$, the portion for forming the hump portion $h_1$, the portion for forming the hump portion $h_2$ and the end portion of the flange portion $Fb_2$, respectively. On the other hand, the forming roll 27 is disposed outside the cylindrical body A so that the roll dies 26*a* to 26*d* are opposite to the roll dies 23*a* to 23*d* of the forming roll 24, respectively.

Then, both the forming rolls 14 and 27 are driven for rotation about the rotation axes and are transferred to each other, whereby the roll dies 23*a* to 23*d* and the roll dies 26a to 26d are pressed on each other through the side wall of the cylindrical body A. Maintaining this press contact state, the forming rolls 24 and 27 are further driven for rotation in the circumferential direction of the cylindrical body A. At this time, the hump portions $h_1$ and $h_2$ are formed between the roll dies 23b and 26b and between the roll dies 23c and 26c, respectively, and the end portions of the flange portions $Fb_1$ and $Fb_2$ are bent between the roll dies 23a and 26a and between the roll dies 23d and 26d, respectively, thereby forming the flange portions $Fb_1$ and $Fb_2$ into the flange portions $F_1$ and $F_2$. Thus, the wheel rim H is obtained.

The wheel rim H can also be obtained by roll forming after the flange portions $Fb_1$ and $Fb_2$ have been thus formed on the cylindrical body A.

What is claimed is:

1. A method for producing a wheel rim of an automotive vehicle including a press forming procedure for forming a cylindrical body formed of a metal material into the wheel rim having flange portions of prescribed shape by press working, said press forming procedure comprising the steps of supporting said cylindrical body at a lower end surface thereof on a vertical axis between an upper punch attached to an upper mold and a lower punch attached to a lower mold; fitting a side die to an outer peripheral surface of said cylindrical body, with said cylindrical body supported; then lowering said upper punch together with the upper mold to insert the upper punch into an upper portion of said cylindrical body and to form the upper end portion of said cylindrical body into said flange portion by press forming between said upper punch and said side die; thereafter releasing said cylindrical body from the supported state at its lower end surface; and further lowering said upper punch together with said side die and said cylindrical body to insert the lower punch into a lower portion of said cylindrical body and to form the lower end portion of said cylindrical body into said flange portion by press forming between said lower punch and said side die.

2. A method as claimed in claim 1, which further comprises the step of forming hump portions on said flange portions by roll forming.

3. A method as claimed in claim 1, which includes a first press forming procedure for forming primary flange portions of prescribed shape on the end portions of said cylindrical body and a second press forming procedure for forming said flange portions into secondary flange portions of prescribed shape by press working, said second press forming procedure comprising the steps of inserting a lower punch attached to a second lower mold into the lower portion of said cylindrical body supported on a vertical axis between an upper punch attached to a second upper mold and said lower punch; fitting a side die to the outer peripheral surface of said cylindrical body, with said lower punch inserted; then lowering said upper punch together with the upper mold to insert the upper punch into the upper portion of said cylindrical body and to form the upper end portion of said cylindrical body into said second flange portion by press forming between said upper punch and said side die; and further lowering said upper punch together with said side die to form the lower end portion of said cylindrical body into said second flange portion by press forming between said side die and said lower punch inserted into the lower portion of said cylindrical body.

4. A method as claimed in claim 3, which further comprises the step of forming hump portions on said second flange portions by press working.

5. A method as claimed in claim 3, which further comprises the step of forming hump portions on said second flange portions by roll forming.

6. A method for producing a wheel rim of an automotive vehicle having flange portions formed on both sides of a cylindrical well portion positioned around the center of the wheel rim, the flange portions being formed into step shape having two steps by first step portions, first side wall portions, second step portions and second side wall portions, respectively, in turn from both ends of the well portion to opening ends of the wheel rim, both the first side wall portions having hump portions curved and projected outward, both the second side wall portions or rim end portions being curved so as to project outward, which comprises the steps of forming both end portions of a cylindrical body formed of a metal material and having the same diameter as the well portion into flange portions having almost the same shape as the above flange portions and having the first step portions, the first side wall portions, the second step portions and the second side wall portions which are smooth; and then, laterally fitting a divided side die to an outer peripheral surface of the cylindrical body having both said flange portions formed and axially pressing said cylindrical body between a pair of punches inserted into both said flange portions, respectively, thereby curving prescribed portions of the first side wall portions of the respective flange portions toward concaves formed on said side die to form said hump portions and curving the second side wall portions of the respective flange portions toward concaves formed on said side die to form said rim end portions.

7. A method as claimed in claim 6, which comprises the primary step of press forming both end portions of said cylindrical body into primary flange portions having almost the same shape as the above flange portions, and having the first step portions, the first side wall portions, the second step portions and the second side wall portions which are smooth, oblique angles of said first and second step portions being smaller than a prescribed angle, and the secondary step of press forming both the primary flange portions by axially pressing the cylindrical body having said primary flange portions until the first and second step portions of said primary flange portions are increased in oblique angle to the prescribed angle, each of the primary flange portions being formed by one press operation in said primary step, each of the flange portions being formed by one press operation in said secondary step.

* * * * *